US010260012B2

(12) United States Patent
Hwang et al.

(10) Patent No.: US 10,260,012 B2
(45) Date of Patent: Apr. 16, 2019

(54) PROCESS FOR REDUCING THE BENZENE CONTENT OF GASOLINE

(71) Applicant: BADGER LICENSING LLC, Boston, MA (US)

(72) Inventors: Shyh-Yuan Henry Hwang, Cambridge, MA (US); Erik J. Moy, South Grafton, MA (US)

(73) Assignee: BADGER LICENSING LLC, Boston, MA (US)

( * ) Notice: Subject to any disclaimer, the term of this patent is extended or adjusted under 35 U.S.C. 154(b) by 0 days.

(21) Appl. No.: 15/528,327

(22) PCT Filed: Nov. 24, 2015

(86) PCT No.: PCT/US2015/062274
§ 371 (c)(1),
(2) Date: May 19, 2017

(87) PCT Pub. No.: WO2016/085908
PCT Pub. Date: Jun. 2, 2016

(65) Prior Publication Data

US 2017/0321134 A1 Nov. 9, 2017

Related U.S. Application Data

(60) Provisional application No. 62/084,158, filed on Nov. 25, 2014, provisional application No. 62/165,310, filed on May 22, 2015.

(51) Int. Cl.
*C10G 57/00* (2006.01)
*C10G 29/20* (2006.01)
(Continued)

(52) U.S. Cl.
CPC ..... *C10G 57/005* (2013.01); *C10G 29/205* (2013.01); *C10G 35/00* (2013.01); *C10G 59/02* (2013.01); *C10G 2400/02* (2013.01)

(58) Field of Classification Search
CPC ..... C10G 57/00; C10G 2400/02
See application file for complete search history.

(56) References Cited

U.S. PATENT DOCUMENTS 5,149,894 A 9/1992 Holtermann et al.
5,336,820 A 8/1994 Owen et al.
(Continued)

FOREIGN PATENT DOCUMENTS

EP 0780458 A2 6/1997
WO 2012108926 A1 8/2012

OTHER PUBLICATIONS

Shah, S.I.A. et al. (2012) International Journal of Chemical Engineering, Article ID 750162, 16 pgs.*
(Continued)

*Primary Examiner* — Brian A McCaig
(74) *Attorney, Agent, or Firm* — Roberts Mlotkowski Safran Cole & Calderon P.C.

(57) ABSTRACT

In a process for reducing the level of benzene in a refinery gasoline feed containing benzene and at least one $C_{4+}$ olefin, the feed is contacted with a first alkylation catalyst under conditions effective to react at least part of the $C_{4+}$ olefin and benzene in the refinery gasoline feed and produce a first effluent containing $C_{10+}$ hydrocarbons. At least part of the $C_{10+}$ hydrocarbons is removed from the first effluent to produce a second effluent, which is then contacted with an alkylating agent selected from one or more $C_2$ to $C_5$ olefins in the presence of a second alkylation catalyst to produce a third effluent which has reduced benzene content as compared with the second effluent.

16 Claims, 6 Drawing Sheets

(51) Int. Cl.
*C10G 59/02* (2006.01)
*C10G 35/00* (2006.01)

(56) References Cited

U.S. PATENT DOCUMENTS

| | | | | |
|---|---|---|---|---|
| 5,414,172 | A * | 5/1995 | Chin | C10G 59/02<br>208/100 |
| 5,545,788 | A | 8/1996 | Cheng et al. | |
| 7,476,774 | B2 | 1/2009 | Umansky et al. | |
| 2003/0171630 | A1* | 9/2003 | Winder | C07C 2/66<br>585/323 |
| 2010/0312033 | A1* | 12/2010 | Kalyanaraman | C07C 7/10<br>585/717 |
| 2018/0044265 | A1* | 2/2018 | Zhu | C07C 7/005 |

OTHER PUBLICATIONS

International Search Report and Written Opinion dated Feb. 12, 2016 in a corresponding application PCT/US2015/062274.

* cited by examiner

PROCESS FOR REDUCING THE BENZENE CONTENT OF GASOLINE

CROSS-REFERENCE TO RELATED APPLICATIONS

The present application is a U.S. National Phase of PCT/US2015/062274 filed on Nov. 24, 2015 claiming priority to U.S. Provisional Patent application No. 62/084,158 filed Nov. 25, 2014 and U.S. Provisional Patent application No. 62/165,310 filed May 22, 2015. The disclosure of the PCT Application is hereby incorporated by reference into the present Application.

FIELD

This invention relates to a process for reducing the benzene content of a refinery gasoline feed.

BACKGROUND

Benzene is considered to be environmentally hazardous. As a result, the State of California and the United States Environmental Protection Agency have instituted regulations to limit the amount of benzene which may be present in gasoline. As of January 2011, the US MSAT-2 (Mobile Source Air Toxics) regulation requires reduction of this annual average benzene content in gasoline to no greater than 0.62 volume %.

One known route for reducing the benzene content of gasoline is to selectively alkylate the benzene using a lower olefin. For example, Holtermann et al U.S. Pat. No. 5,149,894 describes a process for converting benzene to alkylated benzenes in a gasoline blend stock. The process involves contacting a benzene-containing gasoline blend stock with a $C_2$ to $C_4$ olefin stream in the presence of a catalyst containing the zeolite, SSZ-25, to produce an alkylated light hydrocarbon stream with reduced benzene content.

Cheng et al. U.S. Pat. No. 5,545,788 describes a process for the production of a more environmentally suitable gasoline by removing a substantial portion of the benzene in gasoline by alkylation of reformate. The process involves alkylation using a light olefin feed at low temperature over the zeolite catalyst, MCM-49.

Umansky el al. U.S. Pat. No. 7,476,774 describes a process where light olefins including ethylene and propylene are extracted from refinery off-gases, such as from a catalytic cracking unit, into a light aromatic stream, such as a reformate containing benzene and other single ring aromatic compounds, which is then reacted with the light olefins to form a gasoline boiling range product containing alkylaromatics. The alkylation reaction is carried out in the liquid phase with a catalyst which preferably comprises a member of the MWW family of zeolites, such as MCM-22, using a fixed catalyst bed.

However, in addition to limiting the benzene level in gasoline, current and ongoing regulations restrict the content of residue, which consists of heavy hydrocarbon components with boiling points outside the gasoline boiling range. The US standard specification for automotive spark-ignition engine fuel (ASTM D4814) requires that the residue (heavies) in the gasoline product is no more than 2 volume %. Moreover, some refiners have low gasoline endpoint requirements such that, at high benzene conversion during reformate alkylation, the alkylation product may not be fully blendable into the gasoline pool at these refineries. This is believed to be at least partially due to the presence in the reformate feed of $C_4$ and heavier olefins, such as $C_4$-$C_8$ olefins, which, during alkylation, can react with the benzene in the reformate in addition to the added light olefins to produce non-blendable $C_{14}$ and heavier components.

According to the present invention, it has now been found that the undesirable formation of heavy components in the alkylation of a benzene-containing refinery gasoline stream, such as a reformate fraction or light naphtha, with an olefin alkylating agent can be reduced by initially reacting the $C_4$ and heavier olefins in the gasoline stream with part of the benzene component of the gasoline stream to produce a $C_{10+}$ product. This $C_{10+}$ product can then be removed, for example by distillation, before the remainder of the gasoline stream is supplied to an alkylation unit for reaction with added light olefins to further reduce the benzene content of the gasoline.

SUMMARY

Accordingly, in one aspect, the invention resides in a process for reducing the level of benzene in a refinery gasoline feed containing benzene and at least one $C_{4+}$ olefin, said process comprising:

(a) contacting the refinery gasoline feed with a first alkylation catalyst under conditions effective to react at least part of the $C_{4+}$ olefin and benzene in the refinery gasoline feed and produce a first effluent containing $C_{10+}$ hydrocarbons;

(b) removing at least part of the $C_{10+}$ hydrocarbons from the first effluent to produce a second effluent; and (c) contacting at least part of the second effluent with an alkylating agent selected from one or more $C_2$ to $C_5$ olefins in the presence of a second alkylation catalyst under conditions effective to produce a third effluent which has reduced benzene content as compared with the second effluent.

DETAILED DESCRIPTION OF THE EMBODIMENTS

Figure 1:
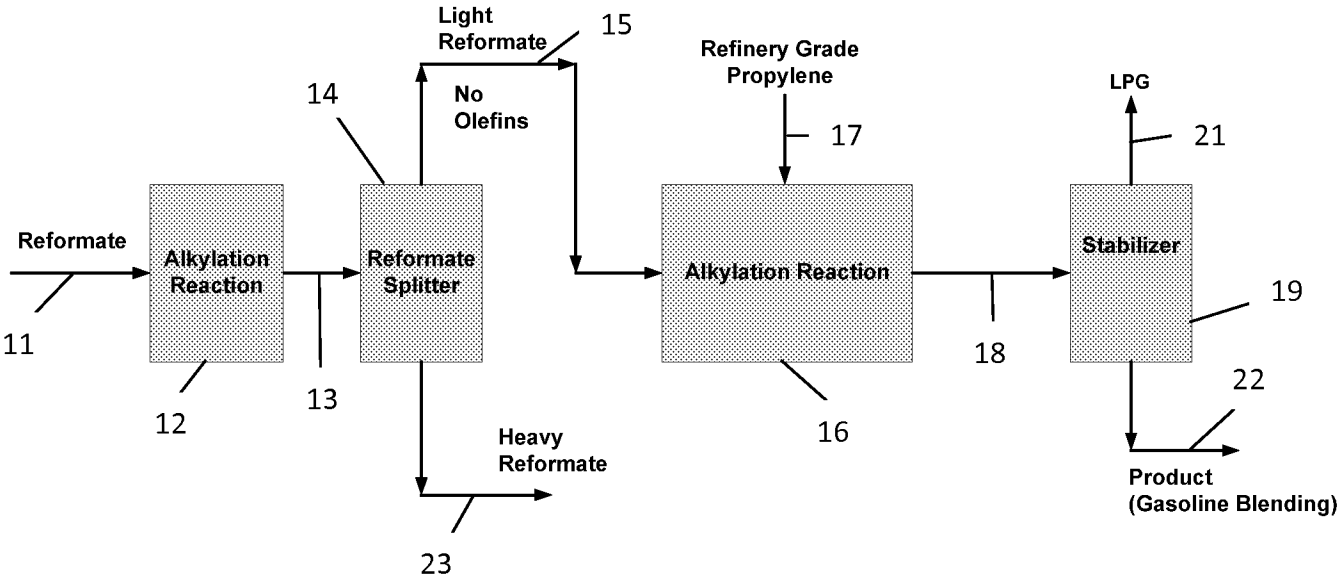
FIG. 1 is a schematic flow diagram of a process for reducing the level of benzene in a refinery gasoline feed according to one embodiment of the invention.

As used herein, the term "$C_n$" hydrocarbon wherein n is a positive integer, e.g., 1, 2, 3, 4, 5, 6, 7, 8, 9, 10, 11, 12, means a hydrocarbon having n number of carbon atom(s) per molecule. The term "$C_{n+}$" hydrocarbon wherein n is a positive integer, e.g., 1, 2, 3, 4, 5, 6, 7, 8, 9, 10, 11, 12, as used herein, means a hydrocarbon having at least n number of carbon atom(s) per molecule. The term "$C_{n-}$" hydrocarbon wherein n is a positive integer, e.g., 1, 2, 3, 4, 5, 6, 7, 8, 9, 10, 11, 12, as used herein, means a hydrocarbon having no more than n number of carbon atom(s) per molecule.

Refinery gasoline streams are blends of different hydrocarbon products generated by various processes in the refinery, particularly catalytic reforming and fluid catalytic cracking. In some embodiments, refinery gasoline streams for use in the present process may have a boiling range at atmospheric pressure from 0° C. to 250° C. Most of these streams contain some level of benzene so that, without treatment, typical refinery gasoline streams contain at least 1 volume % benzene, often at least 4 volume % benzene, such as from 4 volume % to 60 volume % benzene. With the introduction of the US MSAT-2 (Mobile Source Air Toxics) regulations, there is a need to reduce the level of benzene in refinery gasoline streams to an average, annual value of no more than 0.62 volume %.

In addition to limiting the benzene level in gasoline, current and ongoing regulations restrict the content of residue, namely heavy hydrocarbon components with boiling points outside the gasoline boiling range. For example, the US standard specification for automotive spark-ignition engine fuel (ASTM D4814) requires that the residue (boiling at in excess of 225° C.) in the gasoline product is no more than 2 volume %. Thus, any process for reducing the benzene level in refinery gasoline must also avoid excessive generation of heavy by-products.

One potential source of heavies production during treatment of refinery gasoline streams to reduce benzene levels is $C_{4+}$ olefins, such as $C_4$-$C_8$ olefins. Thus, for example, reformate streams blended into the refinery gasoline pool typically contain at least 0.1 volume %, such as from 0.1 volume % to 10.0 volume %, of $C_{4+}$ olefins.

According to the present invention, it has now been found that the joint goal of benzene reduction without excessive heavies production can be achieved by contacting a refinery gasoline feed containing benzene and one or more $C_{4+}$ olefins with a first alkylation catalyst in a first alkylation zone under conditions such that at least part of the $C_{4+}$ olefins and benzene in the feed react to produce a first effluent containing $C_{10+}$ hydrocarbons. At least part of the $C_{10+}$ hydrocarbons are removed from the first effluent to produce a second effluent, which is then contacted with an alkylating agent selected from one or more $C_2$ to $C_5$ olefins in a second alkylation step in the presence of a second alkylation catalyst under conditions effective to produce a third effluent which has reduced benzene content as compared with the second effluent and the refinery gasoline feed.

In one embodiment, the refinery gasoline feed employed in the present process is derived from a reformate, that is the product obtained when petroleum naphtha is contacted with a supported hydrogenation/dehydrogenation catalyst in a catalytic reformer. The resulting reformate is a complex mixture of paraffinic and aromatic hydrocarbons and in most refineries this mixture is supplied to a distillation system, normally called a reformate splitter, to separate the mixture into a plurality of different boiling range fractions. For example, the reformate splitter may separate the reformate into a light reformate fraction, composed mainly of $C_{7-}$ hydrocarbons and having a boiling range at atmospheric pressure from 0° C. to 100° C., and a heavy reformate fraction composed mainly of $C_{8+}$ hydrocarbons and having a boiling range at atmospheric pressure from greater than 100° C. to 250° C. It is to be appreciated that the first alkylation step of the present process, in which benzene and one or more $C_{4+}$ olefins in the feed are reacted to produce $C_{10+}$ hydrocarbons, can be conducted either downstream or upstream of the reformate splitter. In the former case, the first alkylation step of the present process may be conducted on the light reformate fraction. In the latter case, the reformate splitter can be used to remove the $C_{10+}$ alkylation products as well as to effect separation of the reformate into the desired fractions.

First Alkylation Step

Any known alkylation catalyst can be used in the first alkylation step, including both homogeneous and heterogeneous catalysts. In most embodiments, a heterogeneous catalyst, such as a solid acid catalyst, is preferred. Suitable solid acid catalysts include both acidic clays, such as BASF F-24X and F-25X clays and molecular sieves, both naturally-occurring and synthetically produced.

In one embodiment, the alkylation catalyst employed in the first alkylation step comprises at least one medium pore molecular sieve having a Constraint Index of 2-12 (as defined in U.S. Pat. No. 4,016,218). Suitable medium pore molecular sieves include ZSM-5, ZSM-11, ZSM-12, ZSM-22, ZSM-23, ZSM-35, and ZSM-48. ZSM-5 is described in detail in U.S. Pat. Nos. 3,702,886 and Re. 29,948. ZSM-11 is described in detail in U.S. Pat. No. 3,709,979. ZSM-12 is described in U.S. Pat. No. 3,832,449. ZSM-22 is described in U.S. Pat. No. 4,556,477. ZSM-23 is described in U.S. Pat. No. 4,076,842. ZSM-35 is described in U.S. Pat. No. 4,016,245. ZSM-48 is more particularly described in U.S. Pat. No. 4,234,231.

In another embodiment, the alkylation catalyst employed in the first alkylation step comprises at least one molecular sieve of the MCM-22 family. As used herein, the term "molecular sieve of the MCM-22 family" (or "material of the MCM-22 family" or "MCM-22 family material" or "MCM-22 family zeolite") includes one or more of:

- molecular sieves made from a common first degree crystalline building block unit cell, which unit cell has the MWW framework topology. (A unit cell is a spatial arrangement of atoms which if tiled in three-dimensional space describes the crystal structure. Such crystal structures are discussed in the "Atlas of Zeolite Framework Types", Fifth edition, 2001, the entire content of which is incorporated as reference);
- molecular sieves made from a common second degree building block, being a 2-dimensional tiling of such MWW framework topology unit cells, forming a monolayer of one unit cell thickness, preferably one c-unit cell thickness;
- molecular sieves made from common second degree building blocks, being layers of one or more than one unit cell thickness, wherein the layer of more than one unit cell thickness is made from stacking, packing, or binding at least two monolayers of one unit cell thickness. The stacking of such second degree building blocks can be in a regular fashion, an irregular fashion, a random fashion, or any combination thereof; and
- molecular sieves made by any regular or random 2-dimensional or 3-dimensional combination of unit cells having the MWW framework topology.

Molecular sieves of the MCM-22 family include those molecular sieves having an X-ray diffraction pattern including d-spacing maxima at 12.4±0.25, 6.9±0.15, 3.57±0.07 and 3.42±0.07 Angstrom. The X-ray diffraction data used to characterize the material are obtained by standard techniques using the K-alpha doublet of copper as incident radiation and a diffractometer equipped with a scintillation counter and associated computer as the collection system.

Materials of the MCM-22 family include MCM-22 (described in U.S. Pat. No. 4,954,325), PSH-3 (described in U.S. Pat. No. 4,439,409), SSZ-25 (described in U.S. Pat. No. 4,826,667), ERB-1 (described in European Patent No. 0293032), ITQ-1 (described in U.S. Pat. No. 6,077,498), ITQ-2 (described in International Patent Publication No. WO97/17290), MCM-36 (described in U.S. Pat. No. 5,250,277), MCM-49 (described in U.S. Pat. No. 5,236,575), MCM-56 (described in U.S. Pat. No. 5,362,697), UZM-8 (described in U.S. Pat. No. 6,756,030), UZM-8HS (described in U.S. Pat. No. 7,713,513) and mixtures thereof.

In a further embodiment, the alkylation catalyst employed in the first alkylation step comprises one or more large pore molecular sieves having a Constraint Index less than 2. Suitable large pore molecular sieves include zeolite beta, zeolite Y, Ultrastable Y (USY), Ultrahydrophobic Y (UHP-Y), Dealuminized Y (Deal Y), mordenite, ZSM-3, ZSM-4, ZSM-14, ZSM-18, ZSM-20 and mixtures thereof. Zeolite ZSM-3 is described in U.S. Pat. No. 3,415,736. Zeolite ZSM-4 is described in U.S. Pat. No. 4,021,947. Zeolite ZSM-14 is described in U.S. Pat. No. 3,923,636. Zeolite ZSM-18 is described in U.S. Pat. No. 3,950,496. Zeolite ZSM-20 is described in U.S. Pat. No. 3,972,983. Zeolite Beta is described in U.S. Pat. Nos. 3,308,069, and Re. No. 28,341. Low sodium Ultrastable Y molecular sieve (USY) is described in U.S. Pat. Nos. 3,293,192 and 3,449,070. Ultrahydrophobic Y (UHP-Y) is described in U.S. Pat. No. 4,401,556. Dealuminized Y zeolite (Deal Y) may be prepared by the method found in U.S. Pat. No. 3,442,795. Zeolite Y and mordenite are naturally occurring materials but are also available in synthetic forms, such as TEA-mordenite (i.e., synthetic mordenite prepared from a reaction mixture comprising a tetraethylammonium directing agent). TEA-mordenite is disclosed in U.S. Pat. Nos. 3,766,093 and 3,894,104.

Preferred molecular sieves for the first alkylation step comprise zeolite beta, zeolite Y and molecular sieves of the MCM-22 family, as well as combinations thereof.

The above molecular sieves may be used as the alkylation catalyst in the first alkylation step without any binder or matrix, i.e., in so-called self-bound form. Alternatively, the molecular sieve may be composited with binder or matrix material which is resistant to the temperatures and other conditions employed in the alkylation reaction. Such materials include active and inactive materials and synthetic or naturally occurring zeolites as well as inorganic materials such as clays and/or oxides such as alumina, silica, silica-alumina, zirconia, titania, magnesia or mixtures of these and other oxides. The latter may be either naturally occurring or in the form of gelatinous precipitates or gels including mixtures of silica and metal oxides. Clays may also be included with the oxide type binders to modify the mechanical properties of the catalyst or to assist in its manufacture. Use of a material in conjunction with the molecular sieve, i.e., combined therewith or present during its synthesis, which itself is catalytically active may change the conversion and/or selectivity of the catalyst. Inactive materials suitably serve as diluents to control the amount of conversion so that products may be obtained economically and orderly without employing other means for controlling the rate of reaction. These materials may be incorporated into naturally occurring clays, e.g., bentonite and kaolin, to improve the crush strength of the catalyst under commercial operating conditions and function as binders or matrices for the catalyst. The relative proportions of molecular sieve and inorganic oxide matrix vary widely, with the sieve content ranging from about 1 to about 90 percent by weight and more usually, particularly, when the composite is prepared in the form of beads, in the range of about 2 to about 80 weight percent of the composite.

The first alkylation step can be conducted in any known reactor system including, but not limited to, a fixed bed reactor, a moving bed reactor, a fluidized bed reactor and a reactive distillation unit. In addition, the reactor may comprise a single reaction zone or multiple reaction zones located in the same or different reaction vessels. Suitable conditions for the first alkylation step comprise a temperature from 50 to 300° C., such as from 120 to 250° C. and a pressure from 100 to 15,000 kPa-a, such as from 1,000 to 7,000 kPa-a. In one embodiment, the temperature and pressure conditions are selected to maintain the refinery gasoline feed substantially in the liquid phase. In the case of a continuous process, suitable weight hourly space velocities include from 0.1 to 100 $hr^{-1}$.

In the first alkylation step, benzene and $C_{4+}$ olefins present in the refinery gasoline feed react to produce $C_{10+}$ hydrocarbons. Preferably, the first alkylation step is conducted so as to effect substantially complete conversion (for example at least 90 wt %, such as at least 95 wt %, for example at least 99 wt %) of all the $C_{4+}$ olefins present in the refinery gasoline feed. In addition, the first alkylation step is preferably conducted in the substantial absence of added $C_2$ to $C_5$ olefins, that is in the substantial absence of $C_2$ to $C_5$ olefins added separately from the refinery gasoline feed.

Treatment of the First Alkylation Effluent

The effluent from the first alkylation step comprises $C_{10+}$ hydrocarbons, unreacted benzene and the desired gasoline components of the feed. In most embodiments, the effluent is substantially free of $C_{4+}$ olefins. The effluent is initially treated to remove the $C_{10+}$ hydrocarbons and produce a second effluent which is subsequently fed to a second alkylation step. Any known method can be used to effect removal of the $C_{10+}$ hydrocarbons such as, for example, distillation to separate the effluent into a heavy fraction containing the $C_{10+}$ hydrocarbons and light fraction containing the unreacted benzene and the desired gasoline components of the feed. The light fraction is then fed as the second effluent to the second alkylation step.

Second Alkylation Step

In the second alkylation step, at least part of the second effluent is contacted with an alkylating agent selected from one or more $C_2$ to $C_5$ olefins in the presence of a second alkylation catalyst under conditions effective to produce a third effluent which has reduced benzene content as compared with the second effluent. The alkylating agent is added to the second effluent separately from the refinery gasoline feed and in one embodiment comprises propylene, such as an olefin mixture comprising at least 10 mol % propylene and at least 10 mol % butenes.

As in the case of the first alkylation step, any known alkylation catalyst can be used in the second alkylation step, including both homogeneous and heterogeneous catalysts. In most embodiments, a heterogeneous catalyst, such as a solid acid catalyst, is preferred. Suitable solid acid catalysts include both acidic clays, such as BASF F-24X and F-25X clays and molecular sieves, both naturally-occurring and synthetically produced.

In one embodiment, the alkylation catalyst employed in the second alkylation step comprises at least one medium pore molecular sieve having a Constraint Index of 2-12 (as defined in U.S. Pat. No. 4,016,218). Suitable medium pore molecular sieves include ZSM-5, ZSM-11, ZSM-12, ZSM-22, ZSM-23, ZSM-35, and ZSM-48.

In another embodiment, the alkylation catalyst employed in the second alkylation step comprises at least one molecular sieve of the MCM-22 family. Suitable molecular sieves of the MCM-22 family include MCM-22, PSH-3, SSZ-25, ERB-1, ITQ-1, ITQ-2, MCM-36, MCM-49, MCM-56, and UZM-8, UZM-8HS and mixtures thereof.

In a further embodiment, the alkylation catalyst employed in the second alkylation step comprises one or more large pore molecular sieves having a Constraint Index less than 2. Suitable large pore molecular sieves include zeolite beta, zeolite Y, Ultrastable Y (USY), Ultrahydrophobic Y (UHP-Y), Dealuminized Y (Deal Y), mordenite, ZSM-3, ZSM-4, ZSM-14, ZSM-18, ZSM-20 and mixtures thereof.

Preferred molecular sieves for the second alkylation step comprise zeolite beta and/or molecular sieves of the MCM-22 family.

The above molecular sieves may be used as the alkylation catalyst in the second alkylation step without any binder or matrix, i.e., in so-called self-bound form. Alternatively, the molecular sieve may be composited with a binder or matrix material which is resistant to the temperatures and other conditions employed in the alkylation reaction. Such materials include active and inactive materials and synthetic or naturally occurring zeolites as well as inorganic materials such as clays and/or oxides such as alumina, silica, silica-alumina, zirconia, titania, magnesia or mixtures of these and other oxides.

As in the case of the first alkylation step, the second alkylation step can be conducted in any known reactor system including, but not limited to, a fixed bed reactor, a moving bed reactor, a fluidized bed reactor and a reactive distillation unit. In addition, the reactor may comprise a single reaction zone or multiple reaction zones located in the same or different reaction vessels. Suitable conditions for the second alkylation step comprise a temperature from 50 to 300° C., such as from 100 to 250° C. and a pressure from 100 to 15,000 kPa-a, such as from 1,000 to 7,000 kPa-a. In one embodiment, the temperature and pressure conditions in the second alkylation step are selected to maintain the reagents substantially in the liquid phase. In the case of a continuous process, suitable weight hourly space velocities include from 0.1 to 100 $hr^{-1}$.

Even with a refinery gasoline feed comprising at least 10 volume % benzene, the product of the second alkylation step may contain less than 2 volume %, typically less than 0.62 volume %, benzene and generally no more than 2 volume %, typically less than 1.8 volume %, of compounds having a boiling point greater than 236° C. at atmospheric pressure.

The invention will now be more particularly described with reference to FIGS. 1 and 2 of the accompanying drawings, which illustrate processes, according to first and second embodiments of the invention, for producing a gasoline blending stock having a reduced benzene content from reformate.

In the process shown in FIG. 1, the reformate is initially supplied by line 11 to a first alkylation reactor 12 where at least part of the benzene and $C_{4+}$ olefins in the reformate are reacted in the presence of a solid acid alkylation catalyst to produce $C_{10+}$ alkylation products. The effluent from the first alkylation reactor 12 is removed via line 13 and fed to a reformate splitter 14, such as a distillation column, where the effluent is separated at least into a light fraction (typically a $C_{7-}$ containing fraction) and a heavy fraction (typically a $C_{8+}$ containing fraction). The reformate splitter 14 is operated such that substantially all of the $C_{10+}$ alkylation products pass into the heavy fraction.

The light fraction from the reformate splitter 14 is preferably substantially free of $C_{4+}$ olefins from the reformate but still contains some unreacted benzene. At least part of this fraction is then supplied by line 15 to a second alkylation reactor 16, which also receives a supply of refinery grade propylene through line 17. The second alkylation reactor 16 contains a solid acid alkylation catalyst and is maintained under conditions such that benzene in the light fraction reacts with the added propylene to produce predominantly $C_9$ alkylated aromatic products. The effluent from the second alkylation reactor 16 is collected in line 18 and fed to a stabilizer 19, where light gases are removed via line 21 for use as, for example, LPG. The liquid product from the reactor 16 is removed from the stabilizer 19 via line 22. This product contains a low concentration (typically less than 0.62 volume %) of benzene and substantially no $C_{10+}$ hydrocarbons and hence is fully blendable into the gasoline pool.

The heavy fraction from the reformate splitter 14 is collected in line 23 for use in other parts of the refinery, for example for the production of para-xylene. However, since the alkylation products produced in the first alkylation reactor 12 will generally be in the $C_{10}$ to $C_{13}$ range, in many refineries the heavy fraction can also be blended into the gasoline pool.

Figure 2:
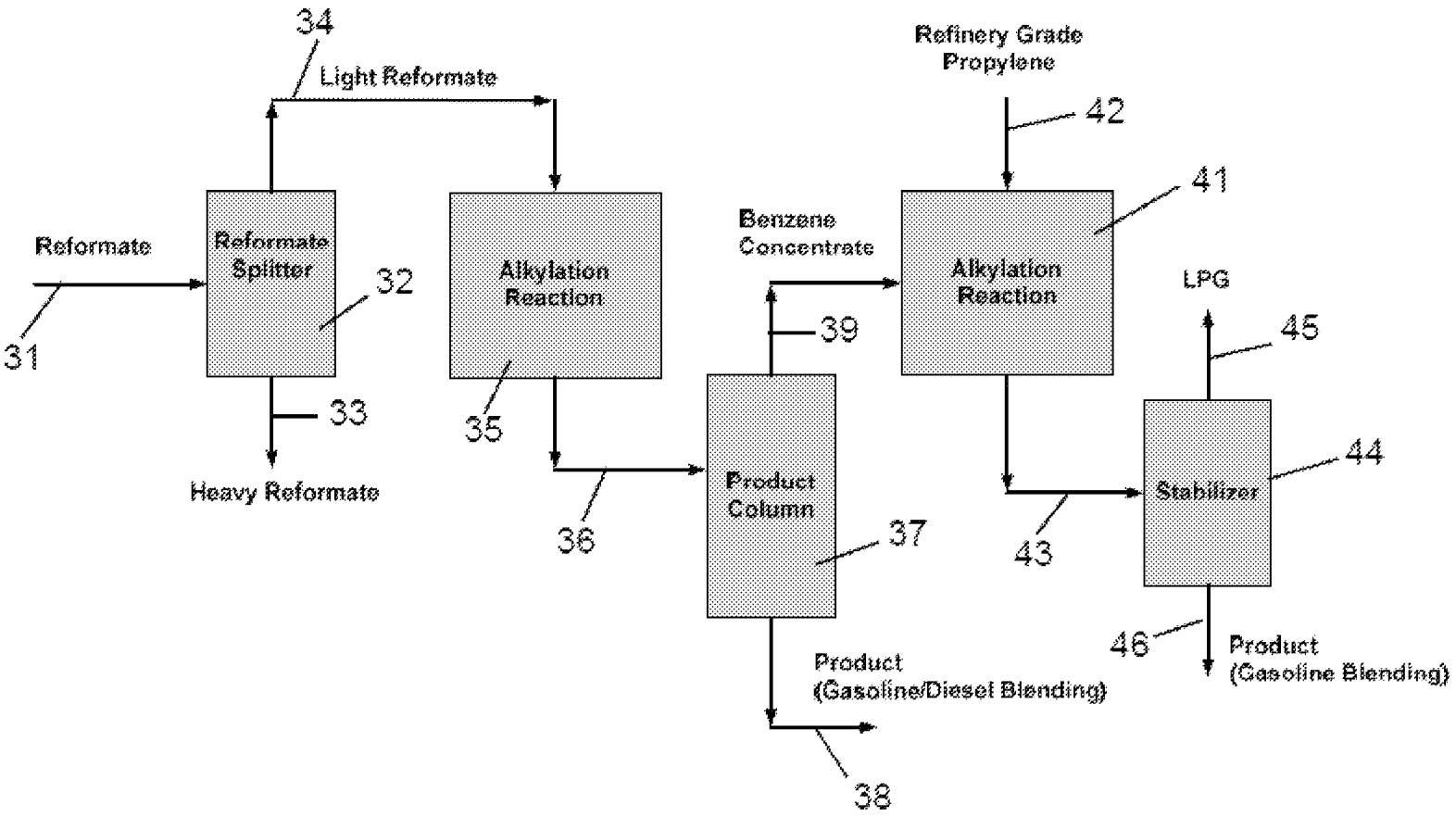
FIG. 2 is a schematic flow diagram of a process for reducing the level of benzene in a refinery gasoline feed according to a further embodiment of the invention.

In the process shown in FIG. 2, the reformate is initially supplied by line 31 to a reformate splitter 32, such as a distillation column, where the reformate is separated at least into a light fraction (typically a $C_{7-}$ containing fraction) and a heavy fraction (typically a $C_{8+}$ containing fraction). The heavy fraction from the reformate splitter 32 is collected in line 33 for use in other parts of the refinery, for example for the production of para-xylene.

The light fraction from the reformate splitter 32 is collected in line 34 and fed to a first alkylation reactor 35 where at least part of the benzene and $C_{4+}$ olefins in the light fraction are reacted in the presence of a solid acid alkylation catalyst to produce $C_{10+}$ alkylation products. The effluent from the first alkylation reactor 35 is removed via line 36 and fed a product distillation column 37 to reconcentrate the remaining benzene in the column overhead. The bottoms of the column 37 (typically a $C_{7+}$ containing fraction) is useful as a gasoline blendstock but a portion may also be blended into the diesel pool.

The benzene-containing overhead from the column 37, which is substantially free of $C_{4+}$ olefins, is then fed by line 39 to a second alkylation reactor 41, which also receives a supply of refinery grade propylene through line 42. The second alkylation reactor 41 contains a solid acid alkylation catalyst and is maintained under conditions such that benzene in the column 37 overhead reacts with the added propylene to produce predominantly $C_9$ alkylated aromatic products. The effluent from the second alkylation reactor 41 is collected in line 43 and fed to a stabilizer 44, where light gases are removed via line 45 for use as, for example, LPG. The liquid product from the reactor 41 is removed from the stabilizer 44 via line 46. This product contains a low concentration (typically less than 0.62 volume %) of benzene and substantially no $C_{10+}$ hydrocarbons and hence is fully blendable into the gasoline pool.

The following non-limited Examples and FIGS. 3 to 6 of the accompanying drawings are provided to further illustrate the processes described herein.

EXAMPLE 1

A commercial Reformate Feed 1 obtained from a US refinery was distilled in a distillation pilot plant to separate the benzene and lighter components contained therein (Light Reformate 1) from those heavier than benzene (Heavy Reformate 1). The Reformate Feed 1 and the resulting Light Reformate 1 and Heavy Reformate 1 streams were analyzed by a Hewlett Packard 6890 Gas Chromatograph equipped with an Agilent DB-1 column having an inside diameter of 0.25 mm, film thickness of 0.5 μm, and length of 100 meters. The streams were also analyzed by ASTM D1159 for Bromine Number to determine their olefin contents. The GC and Bromine Number results together with the olefin content calculated from Bromine Number are listed in Table 1. It was evident that all the reformate streams contained significant amounts of olefin.

TABLE 1

| | Reformate Feed 1 | Light Reformate 1 | Heavy Reformate 1 |
|---|---|---|---|
| Lighter than Bz, % | 33.6% | 77.1% | <0.1% |
| Benzene (Bz), % | 5.6% | 13.1% | 0.1% |
| Heavier than Bz, % | 60.8% | 9.8% | 99.9% |
| Bromine Number, g/100 g | 1.6 | 2.3 | 1.2 |
| Olefin (calculated), % | 0.7% | 0.9% | 0.6% |

EXAMPLE 2

The same Reformate Feed 1 stream used in Example 1 was treated in a fixed bed Reactor 1, made from a ¾ inch (19 mm) diameter Schedule 40 Stainless Steel 316 pipe with a total length of 34 inches (864 cm). Reactor 1 contained 33 grams of a Beta zeolite catalyst. The catalyst was dried with a stream of pure benzene at 150° C. before being contacted with Reformate Feed 1.

A storage tank was used for the Reformate Feed 1 and a positive displacement pump was used to introduce the feed into Reactor 1. The flow rate of Reformate Feed 1 was set by pump setting and monitored by an electronic weight scale. The Reformate Feed 1 was introduced into Reactor 1 at 225 grams per hour for 20 days then the flow rate was raised to 335 grams per hour for one additional day. No separate olefin feed was supplied to Reactor 1. The reactor operating conditions were controlled and monitored by an automatic control system. In particular, the reactor inlet temperature was maintained between 198 and 202° C. during the test. Another storage tank was used to collect the effluent, Reactor Effluent 1, from Reactor 1.

Reactor Effluent 1 was distilled in the same distillation pilot plant used in Example 1 to separate the benzene and lighter components contained therein (Light Reformate 2) from those heavier than benzene (Heavy Reformate 2). The resulting Light Reformate 2 and Heavy Reformate 2 were analyzed by GC and Bromine Number together with Reactor Effluent 1 and their results were listed in Table 2. The exceedingly low olefin content found in Reactor Effluent 1, Light Reformate 2, and Heavy Reformate 2 showed that the olefinic compounds contained in the reformate feed were essentially completely removed in Reactor 1.

TABLE 2

| | Reformate Feed 1 | Reactor Effluent 1 | Light Reformate 2 | Heavy Reformate 2 |
|---|---|---|---|---|
| Lighter than Bz, % | 33.6% | 33.3% | 77.0% | <0.1% |
| Benzene, % | 5.6% | 5.3% | 13.3% | 0.1% |
| Heavier than Bz, % | 60.8% | 61.4% | 9.7% | 99.9% |

TABLE 2-continued

| | Reformate Feed 1 | Reactor Effluent 1 | Light Reformate 2 | Heavy Reformate 2 |
|---|---|---|---|---|
| Bromine Number, g/100 g | 1.6 | <0.02 | <0.02 | <0.02 |
| Olefin (calculated), % | 0.7% | <0.01% | <0.01% | <0.01% |

EXAMPLE 3

An alkylation test of Light Reformate 1 obtained in Example 1 with propylene was carried out in a fixed bed Reactor 2, made from a ¾ inch (19 cm) diameter Schedule 40 Stainless Steel 316 pipe with a total length of 34 inches (864 cm). A storage tank was used for Light Reformate 1 and another tank was used for propylene. A positive displacement pump was used for feeding Light Reformate 1 into Reactor 2 and another positive displacement pump was used for feeding propylene into Reactor 2. The flow rates of Light Reformate 1 and propylene were set by pump settings and monitored by electronic weight scales. The reactor operating conditions were controlled and monitored by an automatic control system. A portion of the reactor effluent was recycled back to the reactor inlet by a centrifugal pump to control the temperature rise across the catalyst bed.

To conduct the test, 30 grams of an MCM-22 family catalyst was initially loaded into Reactor 2. The catalyst was dried with a stream of pure benzene at 150° C. before Light Reformate 1 obtained in Example 1 was introduced. The propylene feed was introduced into Reactor 2 at 9 grams per hour and the reactor inlet temperature was maintained between 198 and 202° C. The reactor recycle was adjusted to control the temperature rise across the catalyst bed to below 20° C. The flow rate of Light Reformate 1 was adjusted to achieve different benzene conversions. The feedstock and reactor effluent were analyzed by the same GC used in Example 1 and the results are shown in FIGS. 3 and 4.

Figure 3:
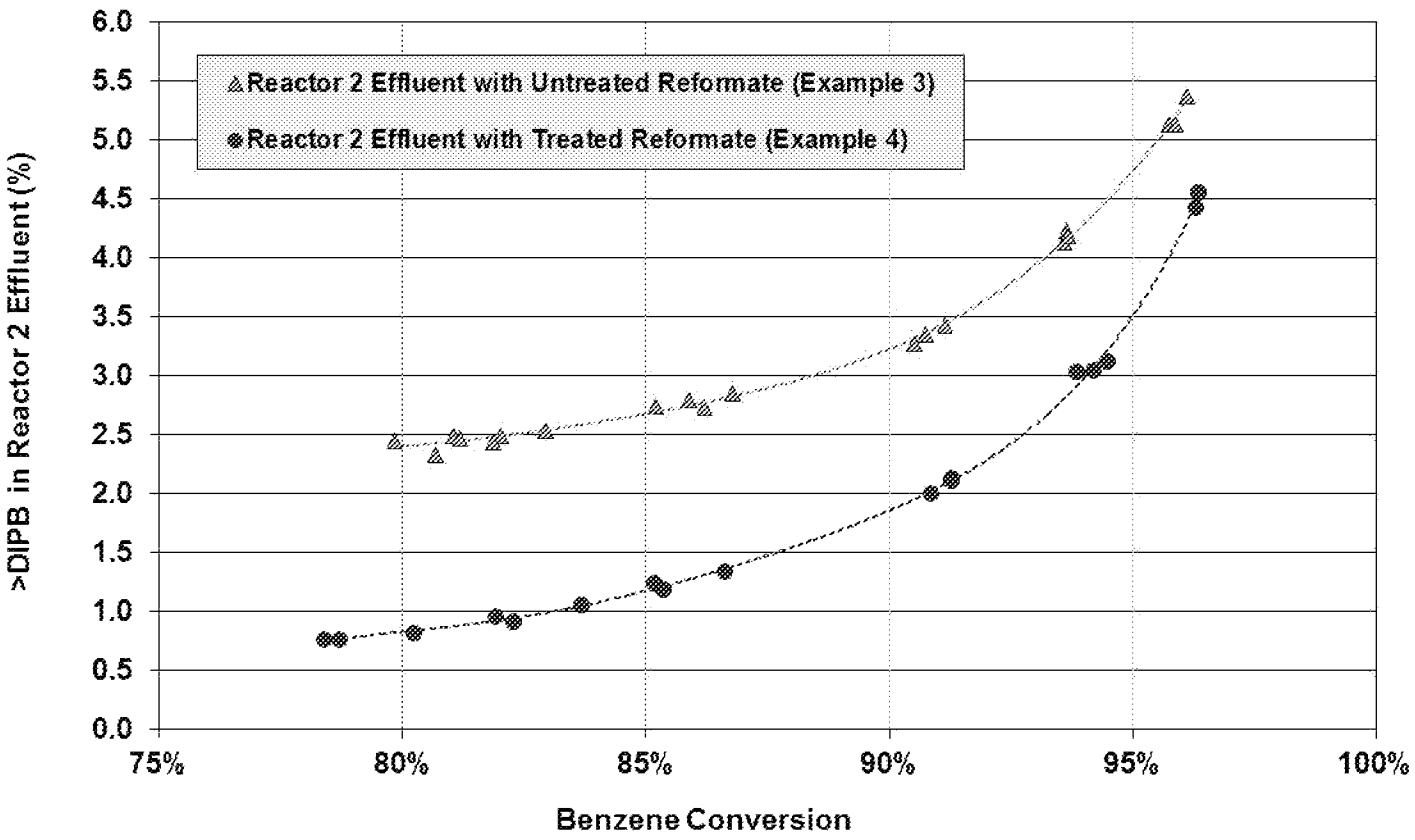
FIG. 3 is a graph comparing the total concentration of components heavier than diisopropylbenzene (DIPB) against benzene conversion for the alkylation reactions of Examples 3 and 4.
Figure 4:
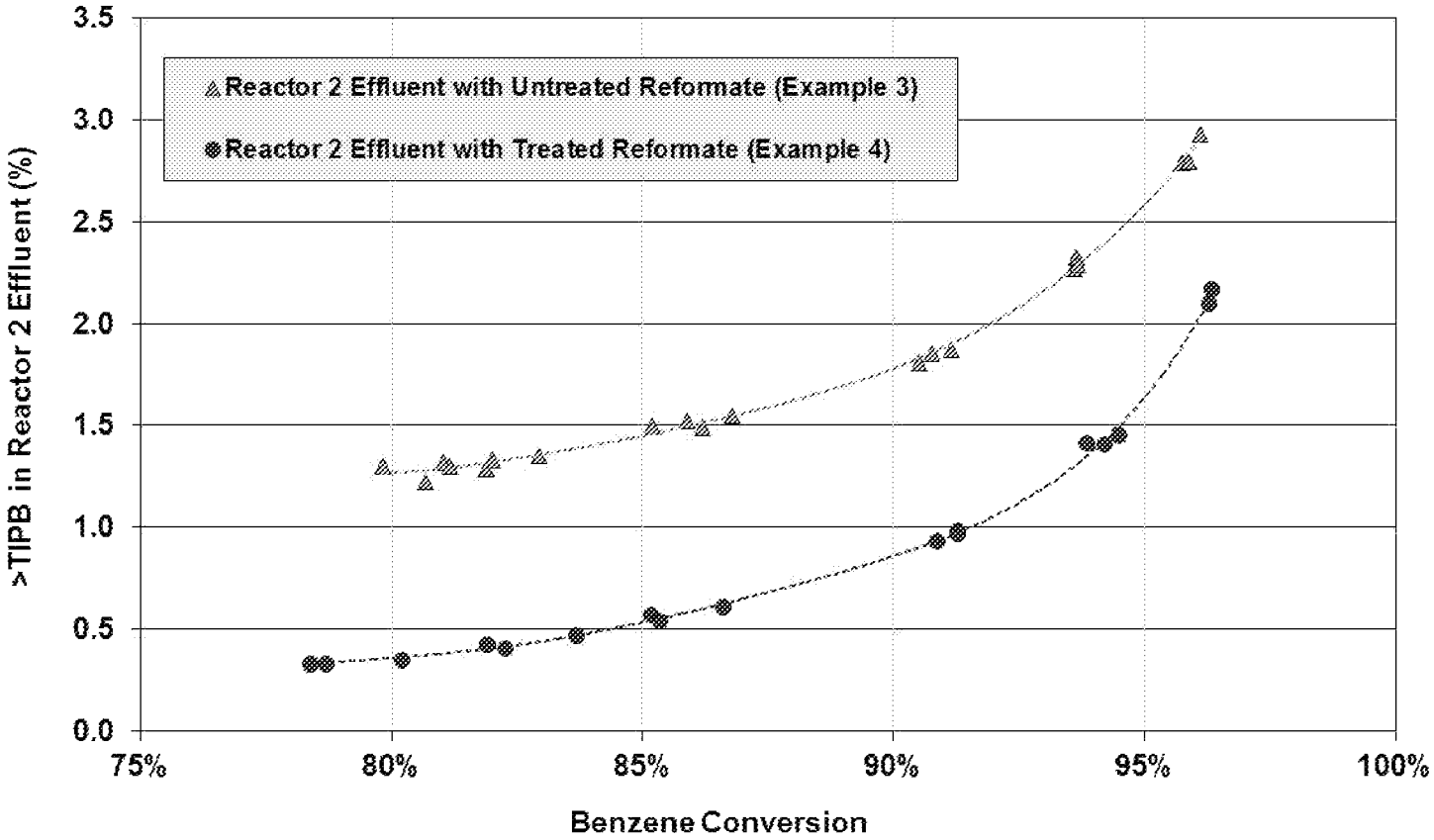
FIG. 4 is a graph comparing the total concentration of components heavier than triisopropylbenzene (TIPB) against benzene conversion for the alkylation reactions of Examples 3 and 4.

As will be seem from FIG. 3, the total concentration of components heavier than diisopropylbenzene (DIPB) in Reactor 2 effluent increased with increasing benzene conversion. Similarly, as shown in FIG. 4, the total concentration of components heavier than triisopropylbenzenes (TIPB) in Reactor 2 effluent also increased with benzene conversion.

EXAMPLE 4

An alkylation test of Light Reformate 2 obtained in Example 2 with propylene was carried out in the same Reactor 2 used in Example 3. The experimental setup, the catalyst used, and the operating conditions were the same as those in Example 3. The total concentration of components heavier than DIPB in Reactor 2 effluent are shown in FIG. 3. The total concentration of the components heavier than TIPB in Reactor 2 effluent are shown in FIG. 4.

The data presented in FIG. 3 demonstrate that the total concentration of components heavier than DIPB in Reactor 2 effluent can be significantly reduced by treating Reformate Feed 1 upstream of the reformate splitter.

The data presented in FIG. 4 demonstrate that the total concentration of components heavier than TIPB in Reactor 2 effluent can also be significantly reduced by treating Reformate Feed 1 upstream of the reformate splitter.

EXAMPLE 5

A commercial Light Reformate 3 obtained from a non-US refinery was analyzed and found to contain 26.3% benzene and 1.2% olefin. An alkylation test of Light Reformate 3 with propylene was carried out in a 2-stage circulating reactor system Reactor 3, comprising two fixed bed reactors in series. Each reactor was made from a ¾ inch (19 cm) diameter Schedule 40 Stainless Steel 316 pipe with a total length of 34 inches (864 cm), loaded with 43 grams of an MCM-22 family catalyst and was dried with a stream of pure benzene at 150° C. A storage tank was used for Light Reformate 3 and another tank was used for propylene. A positive displacement pump was used for feeding Light Reformate 3 into the first reactor. Another positive displacement pump was used for feeding propylene into both the first and the second reactor in 1:1 ratio.

The flow rates of Light Reformate 3 and propylene were set by pump settings and monitored by electronic weight scales. A portion of the first reactor effluent was recycled back to the first reactor inlet by a centrifugal pump to control the temperature rise across the catalyst bed in the first reactor. The net effluent from the first reactor was fed to the second reactor. A portion of the second reactor effluent was recycled back to the second reactor inlet by another centrifugal pump to control the temperature rise across the catalyst bed in the second reactor. The reactor operating conditions were controlled and monitored by an automatic control system.

Figure 5:
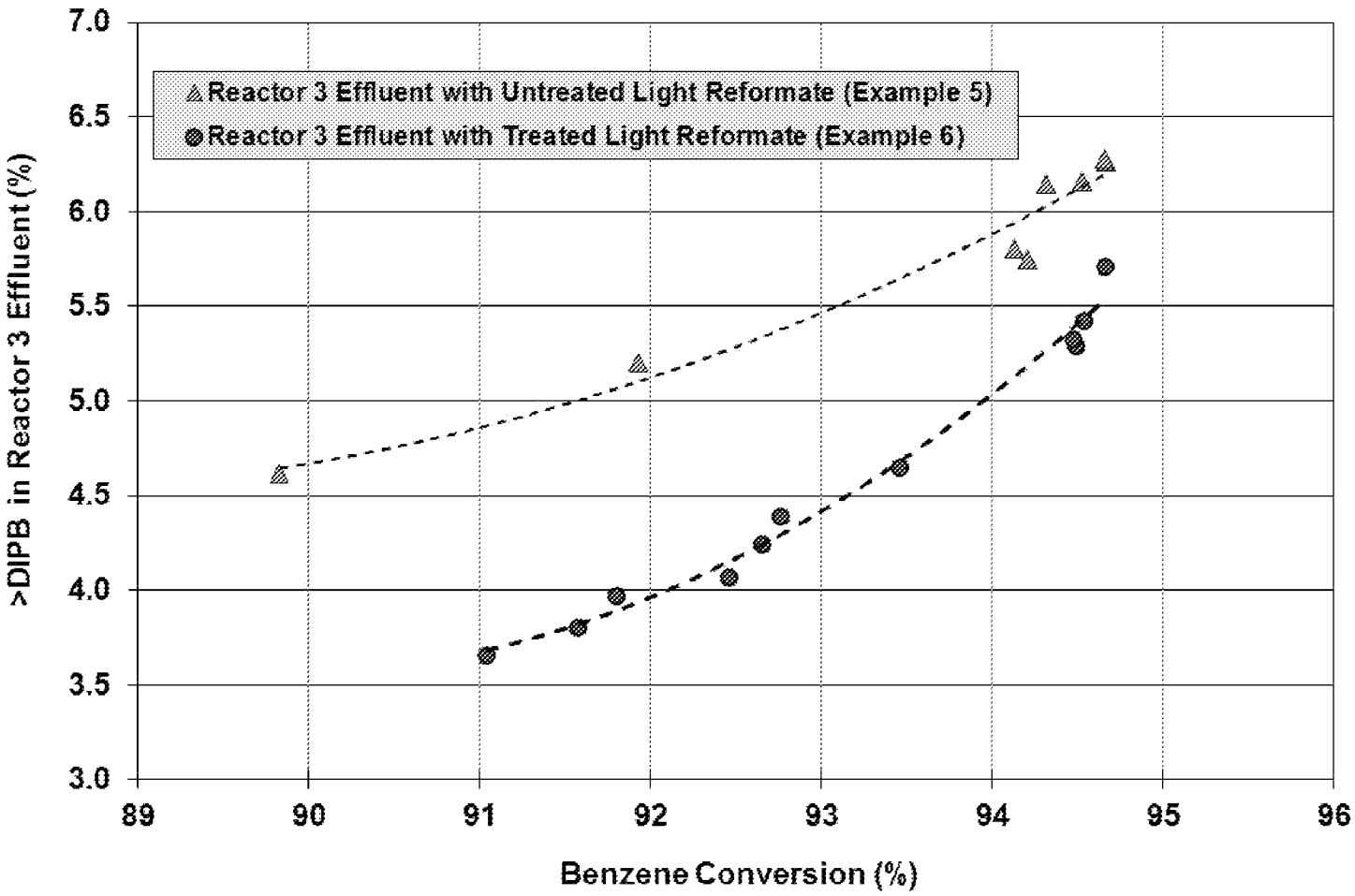
FIG. 5 is a graph comparing the total concentration of components heavier than diisopropylbenzene (DIPB) against benzene conversion for the alkylation reactions of Examples 5 and 6.
Figure 6:
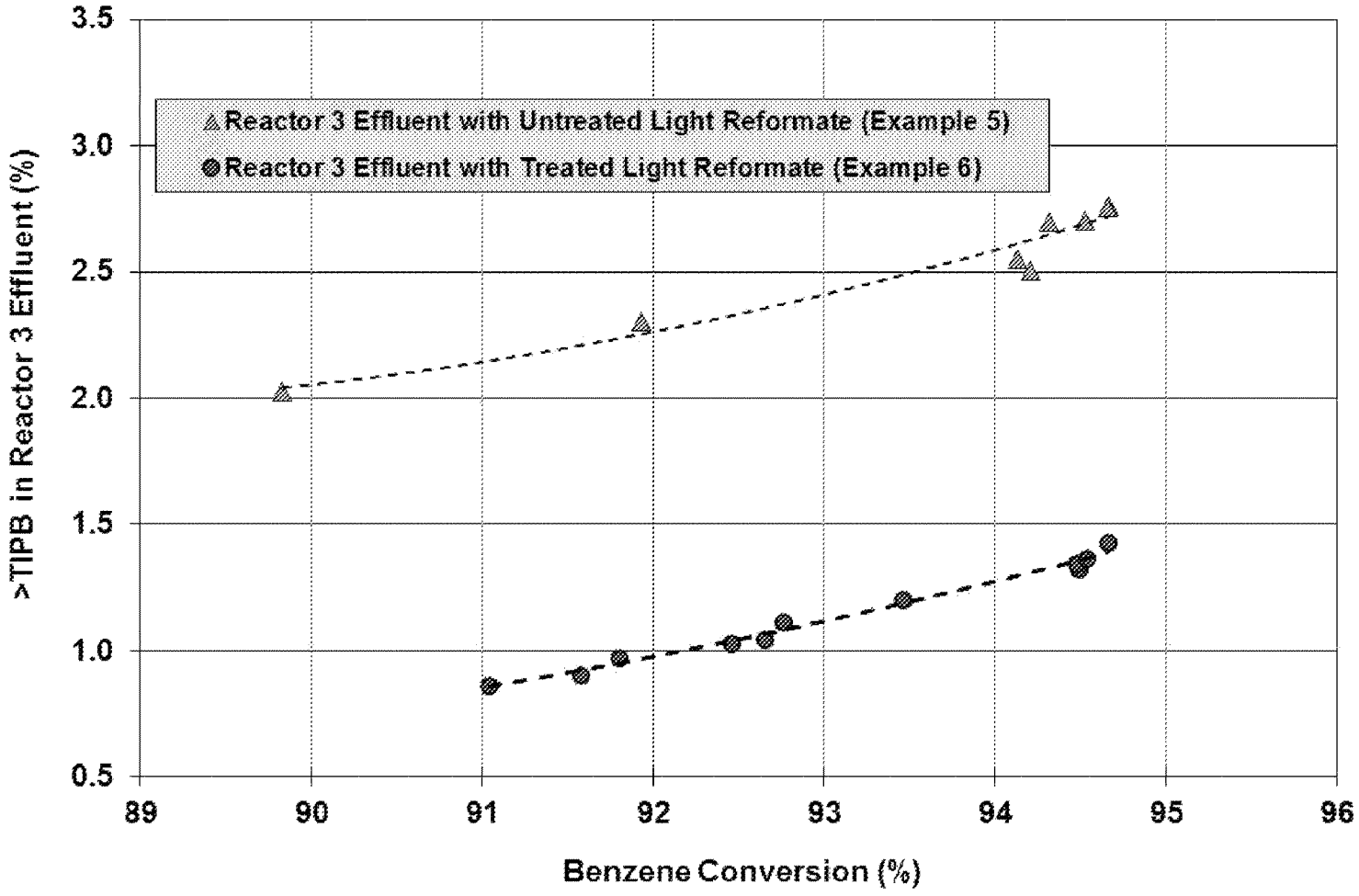
FIG. 6 is a graph comparing the total concentration of components heavier than triisopropylbenzene (TIPB) against benzene conversion for the alkylation reactions of Examples 5 and 6.

The propylene feed was introduced into the 2-stage circulating reactor system Reactor 3 at about 30 grams per hour and the inlet temperature of both the first and the second reactors was maintained between 198 and 202° C. The reactor recycles were adjusted to control the temperature rise across each catalyst bed to below 20° C. Flow rate of Light Reformate 3 was adjusted to achieve different benzene conversions. The total concentration of components heavier than DIPB in Reactor 3 effluent is shown in FIG. 5. The total concentration of the components heavier than TIPB in Reactor 3 effluent is shown in FIG. 6.

EXAMPLE 6

A commercial Light Reformate obtained from the same non-US refinery as in Example 5, and having essentially the same composition as Light Reformate 3 used in Example 5, was treated in a 2-stage once-through reactor system Reactor 4, comprising two fixed bed reactors in series. Each reactor was made from a ¾ inch (19 cm) diameter Schedule 40 Stainless Steel 316 pipe with a total length of 34 inches (864 cm), loaded with 43 grams of an MCM-22 family catalyst and dried with a stream of pure benzene at 150° C. A positive displacement pump was used for feeding the Light Reformate feed into the first reactor. The effluent from the first reactor was fed to the second reactor. The inlet temperature of both reactors was maintained between 198 and 202° C. The Reactor 4 effluent was collected and distilled in the same distillation pilot plant used in Example 1 to separate benzene and lighter components contained therein from those heavier than benzene. The resulting Light Reformate 4 was found to contain 26.5% benzene and no olefin. The absence of olefin in Light Reformate 4 demonstrated the olefinic compounds contained in the reformate feed were completely removed by the treatment with the MCM-22 family catalyst.

An alkylation test of Light Reformate 4 with propylene was carried out in the same 2-stage circulating reactor system Reactor 3 used in Example 5. The experimental setup, the catalyst used, and the operating conditions were the same as those in Example 5. The total concentration of components heavier than DIPB in Reactor 3 effluent is shown in FIG. 5. The total concentration of the components heavier than TIPB in Reactor 3 effluent is shown in FIG. 6.

The data presented in FIG. 5 demonstrate that the total concentration of components heavier than DIPB in Reactor 3 effluent can be significantly reduced by treating Light Reformate over zeolite catalyst followed by distillation to recover olefin-free Light Reformate.

The data presented in FIG. 6 demonstrate that the total concentration of components heavier than TIPB in Reactor 3 effluent can be significantly reduced by treating Light Reformate over zeolite catalyst followed by distillation to recover olefin-free Light Reformate.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A process for reducing the level of benzene in a refinery gasoline feed containing benzene and at least one $C_{4+}$ olefin, said process comprising:

(a) contacting the refinery gasoline feed with a first alkylation catalyst under conditions effective to react at least part of the $C_{4+}$ olefin and benzene in the refinery gasoline feed and produce a first effluent containing $C_{10+}$ hydrocarbons;

(b) removing at least part of the $C_{10+}$ hydrocarbons from the first effluent to produce a second effluent which is substantially free of $C_4$-$C_8$olefins; and (c) contacting at least part of the second effluent with an alkylating agent selected from one or more $C_2$to $C_5$ olefins in the presence of a second alkylation catalyst under conditions effective to produce a third effluent which has reduced benzene content as compared with the second effluent, wherein the contacting (a) is conducted in the substantial absence of $C_2$ to $C_5$olefins added separately from the refinery gasoline feed.

2. A process according to claim 1, wherein the refinery gasoline feed has a boiling range at atmospheric pressure from 0° C. to 250° C.

3. A process according to claim 1, wherein the refinery gasoline feed is a reformate or a fraction thereof.

4. A process according to claim 1, wherein said refinery gasoline feed comprises at least 1 volume % benzene.

5. A process according to claim 1, wherein the first catalyst comprises a solid acid catalyst.

6. A process according to claim 1, wherein the first catalyst comprises an acidic clay.

7. A process according to claim 1, wherein the first catalyst comprises a molecular sieve.

8. A process according to claim 1, wherein the first catalyst comprises zeolite beta, zeolite Y, or a zeolite of the MCM-22 family.

9. A process according to claim 1, wherein conditions in the contacting (a) are sufficient to maintain the refinery gasoline feed substantially in the liquid phase.

10. A process according to claim 1, wherein conditions in the contacting (a) comprise a temperature from 50 to 300° C.

11. A process according to claim 1, wherein the removing (b) comprises distillation.

12. A process according to claim 1, wherein the alkylating agent comprises propylene.

13. A process according to claim 1, wherein the alkylating agent is a composition comprising at least 10 mol % propylene and at least 10 mol % butenes.

14. A process according to claim 1, wherein the second catalyst comprises zeolite beta or a zeolite of the MCM-22 family.

15. A process according to claim 1, wherein conditions in the contacting (c) are sufficient to maintain the second effluent substantially in the liquid phase.

16. A process according to claim 1, wherein the third effluent comprises less than 50 volume % of the benzene in the second effluent.

* * * * *